US006565921B1

(12) United States Patent
Wollin

(10) Patent No.: US 6,565,921 B1
(45) Date of Patent: May 20, 2003

(54) AESTHETICALLY PLEASING STREET SIGN OR OTHER MARKER AND PROCESS FOR MAKING SAME

(76) Inventor: Mark A. Wollin, Rte. 1 Box 33, St. Peter, IL (US) 62880

( * ) Notice: Subject to any disclaimer, the term of this patent is extended or adjusted under 35 U.S.C. 154(b) by 0 days.

(21) Appl. No.: 10/050,614

(22) Filed: Jan. 16, 2002

Related U.S. Application Data

(60) Provisional application No. 60/262,192, filed on Jan. 17, 2001.

(51) Int. Cl.[7] ..... B05D 1/28; B05D 1/38

(52) U.S. Cl. ..... 427/260; 427/261; 427/264; 427/265; 427/287; 427/421; 427/428

(58) Field of Search ..... 427/258, 260, 427/261, 264, 265, 270, 275, 287, 327, 428, 421; 264/293, 284

(56) References Cited

U.S. PATENT DOCUMENTS 1,899,971 A * 3/1933 Meehan
2,587,325 A * 2/1952 Husted
4,191,792 A * 3/1980 Janssen
5,589,021 A 12/1996 Bloom ..... 156/219
6,251,480 B1 * 6/2001 Jackson

* cited by examiner

*Primary Examiner*—Fred J. Parker
(74) *Attorney, Agent, or Firm*—Grace J. Fishel

(57) ABSTRACT

A process for making a three-color street sign or similar marker by applying contrasting colors to an embossed image with a compressible roller. The image having a planar raised portion which is surround by a skirt rising out of the plane of a blank. A first contrasting color applied by the compressible roller to the image with a first force compressing the roller such that the color is applied to the skirt and planar raised portion. A second contrasting color applied by the compressible roller to the image with a second, lower force compressing the roller such that the color is applied to the planar raised portion.

5 Claims, 2 Drawing Sheets

AESTHETICALLY PLEASING STREET SIGN OR OTHER MARKER AND PROCESS FOR MAKING SAME

This application claims the benefit of U.S. provisional application serial No. 60/262,192, filed Jan. 17, 2001.

BACKGROUND OF THE INVENTION

1. Field of the Invention

The present invention relates to a process for making a three-color street sign or other similar marker, the product having an aesthetically pleasing visual appearance.

2. Brief Description of the Prior Art

Steel street signs, including specialty signs licensed by sports organizations for use of team or player names and team logos, are typically made from a metal blank which is embossed with a graphic. The embossed blank is treated with a base coat and dried and the raised portion of the embossed graphic painted and dried. The result is a two-color sign.

On many sports uniforms the players' names, team logo, etc. are displayed in a color outlined in a contrasting color and applied to a jersey or the like in a third color. It would be desirable to have a three-color street sign, particularly for sports licensed products, where the letters and logos are in a color outlined in a contrasting color placed on a background color, in a manner like a team uniform.

On a production basis, it is difficult to produce a three-color street sign with the graphics outlined in a contrasting color. The outline border should be of a consistent width, if the product is to have an aesthetically pleasing visual appearance. Cost, however, is a factor and many printing techniques that might produce an acceptable three-color street sign are ruled out on the basis of price.

It will be appreciated that the demand for a three-color street sign or other marker is not limited to licensed sports products. Street signs and markers with other text, such as "FIREFIGHTERS LANE," "GOD BLESS AMERICA," etc. are also needed.

BRIEF SUMMARY OF THE INVENTION

In view of the above, it is an object of the present invention to provide a three-color street sign or other similar marker which can be economically produced with an outline border of substantially consistent width. It is another object to provide a method for producing a three-color street sign or other marker on a production basis. It is also an object to provide a three-color street sign or other marker which has an aesthetically pleasing visual appearance. Other objects and features of the invention will be in part apparent and in part pointed out hereinafter.

In accordance with the invention, a process for making a three-color street sign or other marker comprises the steps of:

(a) selecting a planar metal blank;

(b) embossing the blank with a graphic image having a generally planar raised portion which is surrounded by a skirt rising out of the plane of the blank;

(c) applying a background color to the embossed blank;

(d) fixing the background color to the embossed blank;

(e) applying a first contrasting color to the generally planar raised portion and surrounding skirt of the embossed image with a compressible roller pressed against the embossed image with a first force;

(f) drying the first contrasting color;

(g) applying a second contrasting color to the planar raised portion of the embossed image with the compressible roller pressed against the embossed image with a second force, less than the first pressure; and (h) drying the second contrasting color;

whereby the generally planar raised portion of the graphic image is outlined with a contrasting border of substantially consistent width set on a background color.

The product of the method as outlined above is a visually aesthetically pleasing three-color street sign or similar marker.

The invention summarized above comprises the method and product hereinafter described, the scope of the invention being indicated by the subjoined claims.

BRIEF DESCRIPTION OF THE SEVERAL VIEWS OF THE DRAWING

FIG. 2(*b*) is a cross-section of the blank after it has been embossed;

FIG. 2(*c*) is a cross-section of the blank after a background color has been applied;

FIG. 2(*d*) is a cross-section of the blank as a first contrasting color is applied with a compressible roller held under a first force; and, FIG. 2(*e*) is a cross-section of the blank as a second contrasting color is applied with the compressible roller held under a second force.

DETAILED DESCRIPTION OF THE INVENTION

Figure 1:
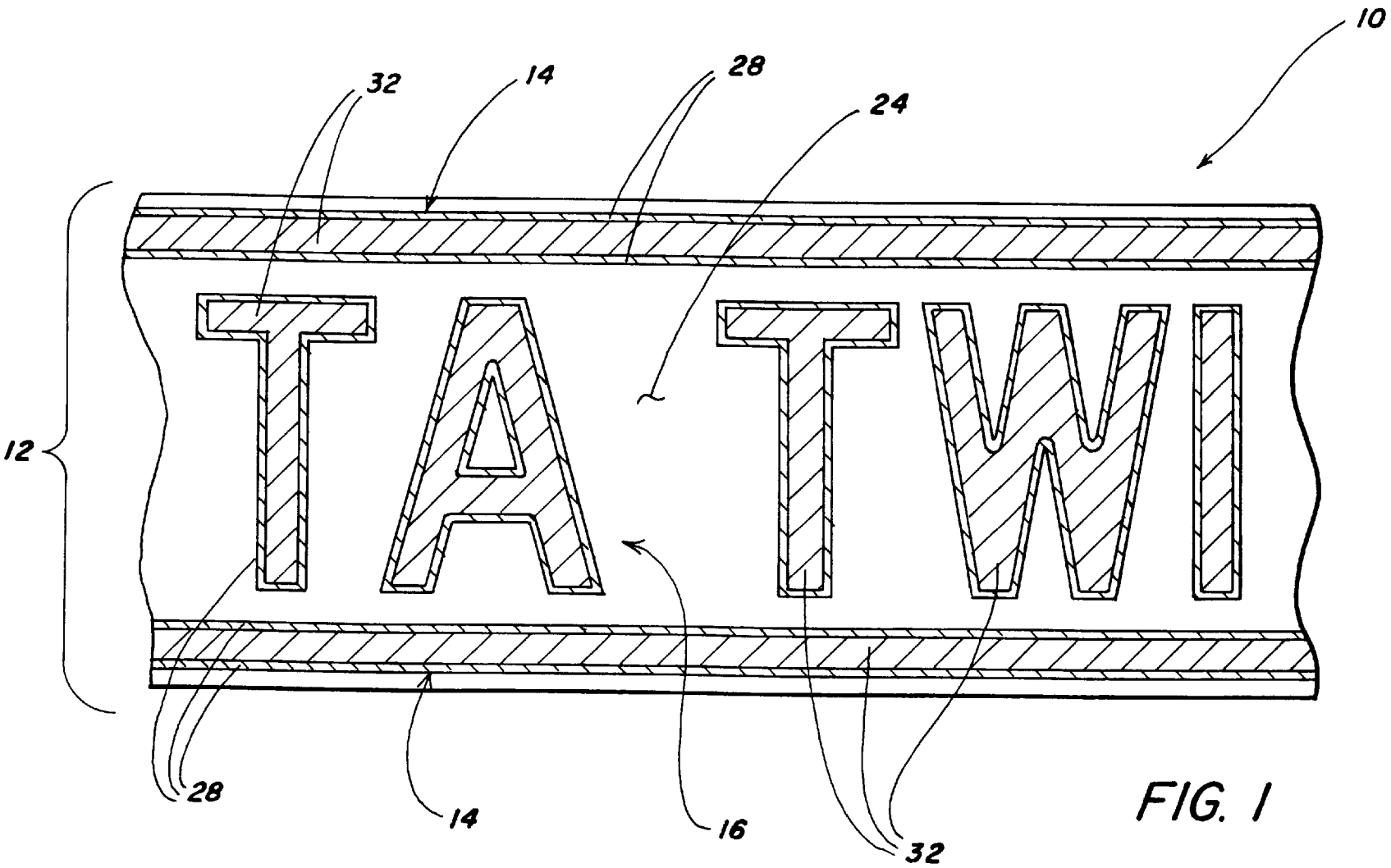
FIG. 1 is a plan view of a portion of a three-color street sign or other similar marker in accordance with the present invention.
Figure 2A:
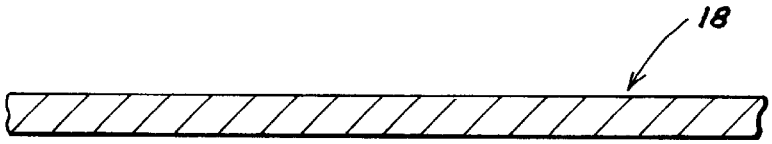
FIG. 2(*a*) is a cross-section of a portion of a metal blank for a street sign or other similar marker.
Figure 2B:
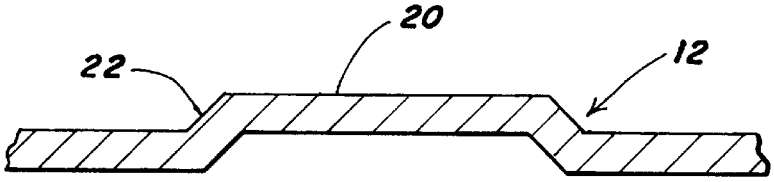
Figure 2C:
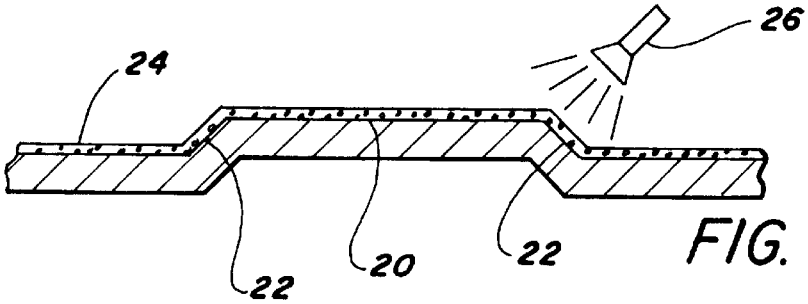
Figure 2D:
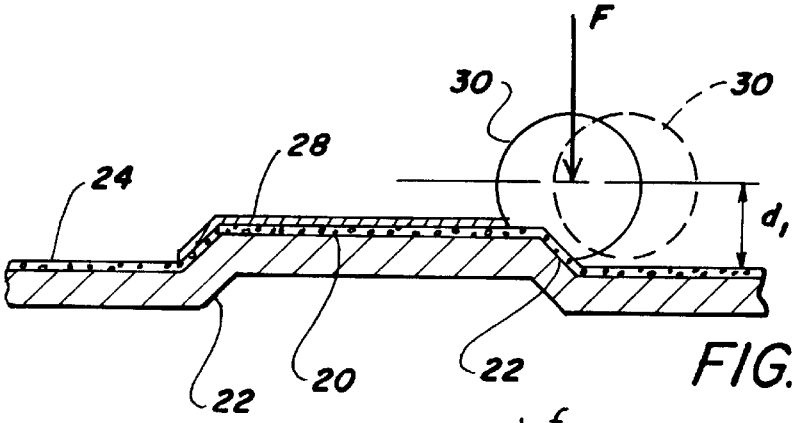
Figure 2E:
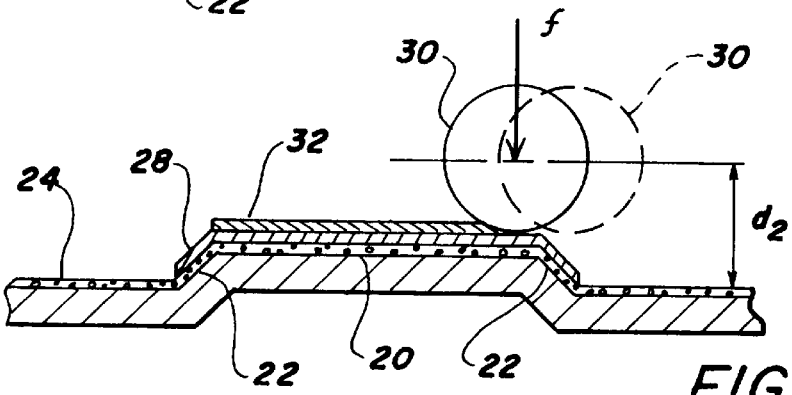

In accordance with the present invention, a three-color street sign or other similar marker 10, a portion of which is shown in FIG. 1, has an image 12 (e.g., frame 14 and text 16). Street sign or marker 10 is formed as shown in FIGS. 2(*a*) through 2(*b*). A flat blank 18 is formed of an embossable metal such as steel, aluminum or the like (FIG. 2(*a*)). Image 12 is embossed in blank 18. Embossed image 12 has a generally planar raised portion 20 which is surrounded by a skirt 22 rising out of the plane of flat blank 18 (FIG. 2(*b*)).

A background color 24 is applied to blank 18 with embossed image 12. When blank 18 is formed of steel, background color 24 may be sprayed 26 on as a powder coat and then fixed by a thermal process. TGIC polyester powder is presently preferred for use as the background color 24 (FIG. 2(*c*)). It will be understood, however, that background color 24 may be applied with a spray and be a paint.

A first contrasting color 28 is applied to planar portion 20 and surrounding skirt 22 of embossed image 12. This is preferably accomplished by applying an ink or paint with a compressible roller 30 made of a rubber or other elastomeric material in a roll coater or the like. Ink or paint is applied to roller 30 with a transfer roller (not shown) or with some other paint transfer system. The spacing between roller 30 and blank 18 is adjusted such that roller 30 passes over the plane of blank 18 at a selected distance ($d_1$). Set at this distance, a first force (F) is applied to roller 30 as it passes over image 12, compressing the roller and applying first contrasting color 28 to skirt 22 and planar portion 20 (FIG.

2(*d*)). First contrasting color 28 is then dried. Depending on the covering capacity of contrasting color 28 it may be necessary to make multiple passes over image 12 with intermediate drying between coats in some cases.

A second contrasting color 32 is applied to planar portion 20. This is accomplished by applying ink or paint to compressible roller 30. The spacing between roller 30 and blank 18 is adjusted such that roller 30 passes over the plane of blank 18 at a selected distance ($d_2$). When roller 30 for applying second contrasting color 32 is identical or of the same kind as the roller for applying first contrasting color 28, a second force (f) less than force (F), is applied to roller 30 as it passes over image 12, compressing the roller and applying second contrasting color 32 to planar portion 20 (FIG. 2(*e*)). Second contrasting color 32 is then dried. As with first contrasting color 28, depending on the covering capacity of second contrasting color 32 it may be necessary to make multiple passes over image 12 with intermediate drying of the color between coats in some cases.

The formulation and viscosity of the ink or paint, nature of the roller and pressure applied may affect the outcome. The time and temperature of fixing or drying steps are conventional and depend upon the powders, paints or inks used. Best results may be obtained by following the manufacturer's recommendations.

Compressible roller 30 shown in FIGS. 2(*d*) and 2(*e*) is not to scale. In a preferred embodiment roller 30 is a rubber roller with a diameter of 9 inches, whereas embossed image 12 typically rises above the planar surface of blank 18 by about ⅛ inch.

The product of the above-described method is a three-color street sign with the embossed graphic outlined in a contrasting color. The outlining is crisp and the result is visually aesthetically pleasing. In the case of a licensed sports sign such as "MINNESOTA TWINS AVE", a portion of which is shown in FIG. 1, the background color may be blue, the first contrasting color white and the second contrasting color red. It will be understood, however, that the invention is not limited to those colors, nor is it limited to licensed sports signs. It will also be understood that the color scheme could have been reversed such that the background color is light, while the first and second contrasting colors are darker.

In view of the above, it will be seen that the several objects of the invention are achieved and other advantageous results attained. As various changes could be made in the above method and product without departing from the scope of the invention, it is intended that all matter contained in the above description or shown in the accompanying drawing shall be interpreted as illustrative and not in a limiting sense.

What is claimed:

1. A process for making a three-color marker comprising the steps of:

(a) selecting a planar metal blank;

(b) embossing the blank with an image having a generally planar raised portion which is surrounded by a skirt rising out of the plane of the blank;

(c) applying a background color to the embossed blank;

(d) fixing the background color to the embossed blank;

(e) applying a first contrasting color to the generally planar raised portion and surrounding skirt of the embossed image with a compressible roller pressed against the embossed image with a first force;

(f) drying the first contrasting color;

(g) applying a second contrasting color to the planar raised portion of the embossed image with the compressible roller pressed against the embossed image with a second force, less than the first force; and (h) drying the second contrasting color;

whereby the generally planar raised portion of the image is outlined with a contrasting border of substantially consistent width set on a background color.

2. The process of claim 1 wherein the background color is applied as a powder coat and fixed by a thermal process.

3. The process of claim 1 wherein the first and second contrasting colors are inks.

4. The process of claim 1 wherein the first and second contrasting colors are paints.

5. A process for making a three-color street sign comprising the steps of:

(a) selecting a planar steel blank;

(b) embossing the blank with an image having a generally planar raised portion which is surrounded by a skirt rising out of the plane of the blank;

(c) applying a background color as a powder coat to the embossed blank;

(d) fixing the background color to the embossed blank;

(e) applying a first contrasting ink to the generally planar raised portion and surrounding skirt of the embossed image with a compressible roller pressed against the embossed image with a first force, repeating this step until a desired degree of coverage is achieved;

(f) drying the first contrasting color;

(g) applying a second contrasting color to the planar raised portion of the embossed image with the compressible roller pressed against the embossed image with a second force, less than the first force, repeating this step until a desired degree of coverage is achieved; and (h) drying the second contrasting color;

whereby the generally planar raised portion of the image is outlined with a contrasting border of substantially consistent width set on a background color.

* * * * *